US008915795B2

(12) United States Patent
Chang

(10) Patent No.: US 8,915,795 B2
(45) Date of Patent: Dec. 23, 2014

(54) GOLF CLUB HAVING DYNAMIC CENTER OF GRAVITY PORTIONS FOR GOLF SWING, FORMED AT THE POSITION OF A SHAFT FIXED BENEATH A GRIP

(76) Inventor: Keun Shik Chang, Daejeon (KR)

( * ) Notice: Subject to any disclaimer, the term of this patent is extended or adjusted under 35 U.S.C. 154(b) by 70 days.

(21) Appl. No.: 13/704,435

(22) PCT Filed: Dec. 8, 2011

(86) PCT No.: PCT/KR2011/009467

§ 371 (c)(1),
(2), (4) Date: Dec. 14, 2012

(87) PCT Pub. No.: WO2012/077990

PCT Pub. Date: Jun. 14, 2012

(65) Prior Publication Data

US 2014/0004970 A1 Jan. 2, 2014

(30) Foreign Application Priority Data

Dec. 10, 2010 (KR) ..... 10-2010-0126464

(51) Int. Cl.

| | |
|---|---|
| ***A63B 53/10*** | (2006.01) |
| ***A63B 53/12*** | (2006.01) |
| ***A63B 53/14*** | (2006.01) |
| ***A63B 53/16*** | (2006.01) |

(52) U.S. Cl.

CPC ..... *A63B 53/145* (2013.01); *A63B 53/16* (2013.01)

USPC ..... 473/303; 473/300; 473/308; 473/316

(58) Field of Classification Search

CPC ..... A63B 53/145; A63B 53/10; A63B 53/12

USPC ..... 473/303, 300, 308, 316

See application file for complete search history.

(56) References Cited

U.S. PATENT DOCUMENTS

| | | | | |
|---|---|---|---|---|
| 4,461,479 | A * | 7/1984 | Mitchell | 473/292 |
| 4,600,195 | A * | 7/1986 | Hunter | 473/297 |
| 4,690,407 | A | 9/1987 | Reisner | |
| 5,465,967 | A | 11/1995 | Boeckenhaupt | |

(Continued)

FOREIGN PATENT DOCUMENTS

| | | |
|---|---|---|
| JP | 09-192267 A | 7/1997 |
| KR | 20-0388314 Y | 6/2005 |

OTHER PUBLICATIONS

International Search Report for PCT/KR2011/009467 mailed on May 8, 2012 from Korean Intellectual Property Office.

*Primary Examiner* — Benjamin Layno
(74) *Attorney, Agent, or Firm* — Sherr & Jiang, PLLC

(57) ABSTRACT

The present invention relates to a golf club in which a shaft arranged beneath a grip portion of the golf club is processed to be used as means for grip swing performed by rotating the golf grip locally between both hands of a golfer. The aim of the present invention is to enable forces of both hands and both arms of the golfer and the weight of the golf club to be dynamically balanced at one or more center of gravity portions (S) designed at a specific position on the shaft beneath the grip during a typical gripping and swinging action of the golfer, that is, said center of gravity portions (S) may serve as a hinge or weight of minimum swing performed between both hands of the golfer, thereby enabling fine swing control.

11 Claims, 3 Drawing Sheets

(56) References Cited

U.S. PATENT DOCUMENTS

| | | | | |
|---|---|---|---|---|
| 6,506,128 | B1 * | 1/2003 | Bloom, Jr. | 473/292 |
| 7,635,310 | B2 * | 12/2009 | Keough | 473/297 |
| 8,066,583 | B2 * | 11/2011 | Rice et al. | 473/282 |
| 2005/0054459 | A1 * | 3/2005 | Oldenburg | 473/297 |
| 2006/0009303 | A1 * | 1/2006 | Prince et al. | 473/297 |
| 2006/0019765 | A1 * | 1/2006 | Plutt | 473/297 |
| 2008/0227562 | A1 * | 9/2008 | Gill | 473/299 |
| 2010/0105498 | A1 | 4/2010 | Johnson | |

* cited by examiner

GOLF CLUB HAVING DYNAMIC CENTER OF GRAVITY PORTIONS FOR GOLF SWING, FORMED AT THE POSITION OF A SHAFT FIXED BENEATH A GRIP

CROSS REFERENCE TO PRIOR APPLICATIONS

This application is a National Stage Patent Application of PCT International Patent Application No. PCT/KR2011/009467 (filed on Dec. 8, 2011) under 35 U.S.C. §371, which claims priority to Korean Patent Application No. 10-2010-0126464 (filed on Dec. 10, 2010), which are all hereby incorporated by reference in their entirety.

TECHNICAL FIELD

The present invention relates to a center-of-gravity device capable of artificially concentrating a club load at a fixed position on a shaft beneath a grip for swing control during a golf swing.

When analyzing a golf swing it is understood that the golf swing has several kinds of pendulum movements. For example, in the case of a backward swing, a first swing is a swing of the upper body and both shoulders in which a spinal column is bent right and is severely twisted using one spinal joint on the buttocks as the axis, a second swing is a left-arm swing in which a straight left arm is turned back in a direction opposite to the target and is raised up using the left shoulder joint as the axis, a third swing is a grip swing in which a golf club, which returns back by a movement of both arms, is rotated locally within hands using a certain hinge point formed in the grip of a right hand (in the case of a right-handed golfer), a fourth swing is a right-wrist swing in which the left wrist is twisted and the right wrist joint is bent back so as to make a big swing arc, a fifth swing is a right-arm swing rotated using the right shoulder joint as the axis in which the right arm, which has been bent in an L-shape in the back of the head by returning back in the back swing, is unfolded and thrown out at an impact of a forward swing. Here, the role of the third grip swing is very important in club swings, but is not well known to weekend golfers and golf beginners.

The features of the grip swing are as follows. First, among the above swings, the axes of rotation of the upper-body-and-both-shoulder swing, the left-arm swing, the right-wrist swing and the right-arm swing are positioned within the body, but the axis of the grip swing is positioned outside the body, that is, on one shaft axis under the grip held by both hands. Second, a dynamic weight balance is formed in a dual pendulum system consisting of both arms and a golf club through the axis of the grip swing. Third, the remaining portion of the grip for the axis of the grip swing within hands is relatively rotated. Fourth, the swing of the left arm (in a broad sense, both arms) is connected with the swing of the golf club through the grip swing made within hands, and thus the grip swing regulates the size of the arc radius of the golf swing, or significantly affects soft connection between the body and the swing of the club. Fifth, generally, in order to form the axis of the grip swing within the grip of both hands, the grip needs to be taken softly, for example, the intensity of the grip should be about 85% of the common intensity, but the beginners tend to take a too strong grip, thereby spoiling the swing.

In the forward swing, there are a take-down which pulls down a club from the top to the bottom while releasing the twist of the spine, a left-hand swing which pulls down the left arm, which is unfolded straight, from the top to the bottom, and rotates the left arm in a target direction along with the rotation of the both shoulders, a right-arm swing (so called, late hitting) which lowers the bent right arm along the right side of the upper body and throws out the right arm in a target direction right before the impact, a right-wrist uncocking which suddenly releases the cocking of the right wrist at the time of an impact, and a reverse motion of the grip swing in which the remaining portion of the club is relatively rotated in a target direction for a certain hinge point on the shaft within both moving hands. When the above five swing movements form coordinated motions in sequence, the impact of the club head, which is finished within 0.2 to 0.4 seconds, gets big, and an appropriate line of flight is made.

In a vacuum gravity field without air resistance, a ball, which rises into the air, would exactly draw a parabola, but because the inertia of the ball, gravity, air resistance, Magnus lift due to the back spin, wind force due to the wind in all direction, etc. would affect the ball so that the ball would draw a distorted ballistic trajectory in which the ball rises up and rapidly falls down. The side spin is generated because the face plane is opened or closed and thereby the ball is attached in a skew angle when the take-down plane of both arms and the upper body are not parallel to the target line, but becomes outside-in or inside-out. As such, the side Magnus lift, which pushes the flying ball to the right or left, is generated, and thereby the trajectory is bent right or left. This may become a means for controlling a ball of a concept of a draw or fade, but when the level gets severe, an uncontrolled shot such as a hook or a slice may occur. The bad effect caused by an attack on the ball in a skew angel is particularly serious in putting. Golfers, who can move a ball by 300 yards using a driver in a tee box, may miss a short putting of about 6 feet in the green in PGA tour, and thereby lose the entire 18 hall game of the day or even the entire match of 72 halls of four days, which is a paradox of golf. The right putting method is a straight putting along the putting line in the case of a flat green, in which the sweet spot of the putter head hits the ball and thereby the ball rolls straight without a side spin.

BACKGROUND ART

The present invention relates to a dynamic center of gravity, which is fixed at one or more specific positions on the shaft beneath a grip potion in a golf club, and is used as a hinge or weight of the grip swing, thereby improving stability, accuracy and power of the swing. When there are several dynamic centers of gravity within hands, a mini swing, which uses the upper center of gravity as a hinge and the lower center of gravity as weight, is possible, and this has outstanding effects on the swing control such as putting. Generally, a golf swing is composed of a left-arm swing, an upper-body-and-both-shoulder swing, a wrist swing, a grip swing, a right-arm swing, etc. The grip swing is formed locally within hands, and although the movement within hands is small, the grip swing has a swing control element which can softly connect the take-away or take-up by maintaining the dynamic balance between the force of the arm and the weight of the club. In other words, the dual pendulum motion system, which is composed of a club swing and a both-arm swing through the grip swing, may be triggered and maintained, and thus the role of the grip swing is very important. The present invention has been designed to provide one or more artificial centers of gravity on the shaft within both hands when gripping the club, so as to easily use the center of gravity as the axis or weight of the grip swing in a golf swing. The concept of the dynamic center of gravity of the swing system is totally different from the static center of gravity of the golf club itself. When the shaft of the club is bound by a thread and hung, if the club takes a horizontal posture by the right and left weight balance, the static center of gravity is in the position of the thread. However, the dynamic center of gravity indicates one point on the shaft within the grip of both hands, which is the point in which the force pulling the club upward by both arms and both hands is balanced with the force pulling the club down by gravity. The take-away is started well without using a wrist in the putting or the swing of the driver club and iron. The present invention imitates a principle of a pendulum motion which repeats the accurate swing as described above, and is particularly useful for the putting that requires the accurate swing. Even in the swing of the driver or iron, when proceeded from the take-away to the take-up, the force of both arms and both hands is always dynamically balanced in the center of gravity of the grip swing. As such, the appropriate grip swing leads to an appropriate wrist swing, left-arm swing, upper-body-and-both-shoulder swing, right-arm swing, etc., and thus the effects of the present invention are still valid.

DISCLOSURE

Technical Problem

An object of the present invention devised to solve the problem lies in providing one or more centers of gravity on the shaft beneath the grip so that golfers easily make the axis of the grip swing, which is difficult to be formed using a general method in a golf grip held by ten fingers of both hands, within hands. In other words, the present invention artificially sets the center of gravity on the shaft so that the concentrated weight of the club may be felt during a swing by designating a specific position on the shaft beneath the grip, particularly a position where the thumb and forefinger of the right hand holds the grip, a position where the thumb and forefinger of the left hand holds the grip, and a position where the little finger of the left hand holds the grip. The objects of the present invention are as follows. First, the present invention awakens golfers of the principle and importance of a grip swing from the perspective of golf mechanics. Second, the present invention provides a practical means for easily implementing the axis of the grip swing, which is generally different to be formed, using the center of gravity of the present invention. Third, the center of gravity has effects of concentrating the weight of the golf club, and thus when several centers of gravity are provided, a mini swing within the grip of both hands, in which the upper center of gravity is used as a hinge and the lower center of gravity is used as weight, is possible, and this may be a useful means for accurate swing control. Fourth, the theory of the golf swing such as putting, which has been complicated, becomes simple. Fifth, the theory of the grip swing and a method for implementing the same according to the present invention may be commonly applied to any golf club having a shaft such as a putter, iron, wood, driver, etc.

Technical Solution

An object of the present invention can be achieved by providing a golf club including a shaft 300 having a head hitting a golf ball at an end of one side, a grip 200 provided in a form of surrounding the shaft 330 at an end of the other side of the shaft, the grip 200 serving as a handle, wherein a center of gravity (S) is provided on an axis of the shaft 300 at a designed specific position inside a grip of both hands, the center of gravity (S) concentrating weight of the golf club.

The shaft 300 may be cut into a lower shaft 1 300*a* on a club head side and an upper shaft 2 300*b* on a club grip side around a bottom entry of the grip 200, and is assembled to form a single axis by insertion of one connecting rod 330, and the grip 200 may be coupled with the cut upper short shaft 2 300*b* by accommodating all sections of the shaft.

The connecting rod 330 may be made of plastic or light metal material, the connecting rod 330 may be directly and firmly coupled with the lower shaft 1 300*a* using at least one means selected among welding, a screw, a rivet, a glue, shrink-fit, and brazing as a lower connection core 330*a* with a small width, the end of one side, is inserted into the lower long shaft 1 300*a*, and the connecting rod 330 may be firmly coupled with the upper shaft 300*b* using at least one means selected among welding, a screw, a rivet, a glue, shrink-fit, and brazing as an upper connection core 330*b* with a small width, the end of the other side, is inserted into the upper short shaft 2 300*b*.

The connecting rod 330 may be firmly coupled with the upper shaft 300*b* using at least one means selected among welding, a screw, a rivet, a glue, shrink-fit, and brazing as a sleeve 400*b* integrally formed outside the upper connection core 330*b* with a small width, the end of the other side, is inserted into the upper short shaft 2 300*b*.

Here, the upper connection core 330*b* of the connecting rod is preferably coupled with the insider of the short shaft 2 300*b* by designating a specific position where the thumb and forefinger of the right hand may be placed when generally grabbing the grip with both hands. Further, in the same specific position, as a structure of the connecting rod, relatively a long sleeve 400*b* in inserted into the short shaft 2 300*b* in order to support the upper connection core 330*b* with a small width, and is firmly coupled to form the center of gravity (S) through means such as welding, a screw, a rivet, a glue, shrink-fit, brazing, etc.

Here, the upper short shaft 2 300*b* may be cut into two or more partial shafts 300*b*1, 300*b*2 and 300*b*3, the partial shafts 300*b*1, 300*b*2 and 300*b*3 may be assembled by the connecting rod 330, and all of which are accommodated inside the grip 200, the connecting rod 330 may integrally form a plurality of connection cores 330*b*1, 330*b*2 and 330*b*3 dispersed and coupled for each of the partial shafts 300*b*1, 300*b*2 and 300*b*3, and the connection cores 330*b*1, 330*b*2 and 330*b*3 may be directly coupled with each of the partial shafts 300*b*1, 300*b*2 and 300*b*3 using at least one means selected among welding, a screw, a rivet, a glue, shrink-fit, and brazing.

When the mechanical coupling force between the connection cores 330*b*1, 330*b*2 and 330*b*3 of the connecting rod 330 and the partial shafts is weak, as a structure of the connecting rod, relatively long sleeves 400*b*1, 400*b*2 and 400*b*3 are integrally formed outside each of the three connection cores 330*b*1, 330*b*2 and 330*b*3, and may be firmly coupled with the partial shafts 300*b*1, 300*b*2 and 300*b*3 using means such as welding, a screw, a rivet, a glue, shrink-fit, brazing, etc.

With respect to a method of implementing a center of gravity (S) of a golf club, a case in which there are two connection cores may be summarized as follows.

The shaft 300 is cut into two parts around the entrance beneath the rubber grip 200. One is a long lower shaft 1 300*a* and the other is a short upper shaft 2 300*b*. One connecting rod 330 made of light and strong material is inserted into the two shafts, and is assembled to form a single axis. The lower connection core 330*a*, one side of the connecting rod 330, is inserted into the lower long shaft 1 300*a* and is firmly coupled, and the upper connection core 330*b* having the low width, the end of the other end of the connecting rod 330, is inserted into the short upper shaft 2 300*b*, and is firmly coupled using means such as welding, a screw, a rivet, a glue, shrink-fit, brazing, etc. When the coupling force with the upper shaft 2 300*b* is weak due to the small width of the connection core 330*b*, as a structure of the connecting rod, relatively long sleeve 400*b* is integrally formed outside the connection core, so the sleeve 400*b* is inserted into the shaft 2 300*b*, and is firmly coupled with the shaft 2 300*b* using means such as welding, a screw, a rivet, a glue, shrink-fit, brazing, etc.

A case in which there are two connection cores is used as an example, and a principle that the center of gravity (S) provided by the connection core in the swing system formed by both hands and a golf club of a golfer may be used as the dynamic center of gravity of the golf swing, will be described in detail below.

The shaft of the golf club is cut into two shafts around the bottom entrance of the rubber grip, a lower long shaft 1 300*a* and an upper short shaft 2 300*b*. Shaft 1 300*a* and shaft 2 300*b* are assembled to form a single axis using one light and strong connecting rod 330 inserted inside. The lower connection core 330*a* having relatively a long width is firmly coupled with the shaft 1 300*a* using means such as welding, a screw, a rivet, a glue, shrink-fit, brazing, etc. at the inside of the shaft 1 300*a*, and the upper connection core 330*b* having a small width is firmly coupled with the shaft 2 300*b* in the same manner, but the remaining parts of the connecting rod 330 are not coupled because of a relatively small diameter.

If a club is raised up with both hands in order to perform a swing, force of both arms and hands on the grip is transmitted to shaft 2 300*b*, and in turn, the force is transmitted to the upper connection core 330*b* of the connecting rod coupled with the shaft 2 300*b* at the center of gravity (S) position. In a reverse manner, the weight of the club head below the club is transmitted to the lower connection core 330*a* of the connecting rod, and is then transmitted to the upper connection core 330*b*, the end of the other side, through the connecting rod. Hence, the center of gravity (S) clearly forms the equilibrium point of weight of the swing system constituted by both hands and the golf club. Hence, the golfer would feel as if the weight of the golf club were concentrated on the center of gravity (S) within hands, and the center of gravity (S) may be used as a hinge axis of the club swing according to the clock pendulum principle to be described later. Further, when a plurality of centers of gravity are dispersed at a certain position of the shaft beneath the grip, the upper center of gravity may be used a hinge, and the lower center of gravity may be used as the weight (clock pendulum), and thus the centers of gravity may be easily used as a swing control means by forming a mini swing system within hands.

When the sleeve 400*b* integrally formed outside the connection core 330*b* is mechanically coupled with the upper shaft 2 300*b*, the weight of the club head reaches the upper connection core 330*b* through the connecting rod 330 and the lower connection core 330*a* connected to the lower shaft 1 300*a*, the force of both hands holing the grip is transmitted to the upper shaft 2 300*b* and is then transmitted to the upper connection core 330*b* in the sleeve 400*b*. Hence, the connection core 330*b* sufficiently plays a role of center of gravity (S) of a golf swing.

Advantageous Effects

According to the present invention, artificial centers of gravity (S) are provided by selecting one or more specific positions on the shaft inside the grip, and because the centers of gravity (S) are spots where the force of both arms and both hands is dynamically balanced with the weight of the golf club when the club is grabbed using both hands, the centers of gravity (S) may be used as the axis or weight of the grip swing. In the center of weight (S), the weight of the golf club is not dispersed, but is concentrated. As such, the swing moment increases and the golfers feel the existence of the center of gravity in their hands, and thus it is easy to use the center of gravity as a hinge point of the grip swing. In the case of a right-handed golfer, when a connecting rod having four joint cores is used, for example, if the position of the first joint core on the upper side is grabbed using the littler finger of the left hand, the position of the second joint core on the middle side is grabbed using the thumb and forefinger of the left hand, and the position of the third joint core of the lower side is softly grabbed using the thumb and forefinger of the right hand, the fingers positioned in each joint core may feel the weight of the lower long shaft 2 and club head selectively coupled with the fourth joint core positioned in the bottom, and thus each of them may play a role of the center of gravity (S). In other words, according to the pendulum principle which will be described later, each of the centers of gravity (S) may become a hinge on each of the relatively lower centers of gravity (S) and may also become a weight on each of the relatively upper other centers of gravity (S), and thus the centers of gravity (S) form a mini swing within hands, thereby playing a role of swing control. The golf club, which is performed in the present invention, allows a elaborate and stable swing compared to the conventional golf club without any solution, allows constancy of a swing, increases the distance of the ball movement by the increase of impact, and allows accurate direction of the ball.

DESCRIPTION OF SYMBOLS USED IN DRAWINGS

200: grip

300: shaft

300*a*: long shaft 1

300*b*: short shaft 2

Figure 1:
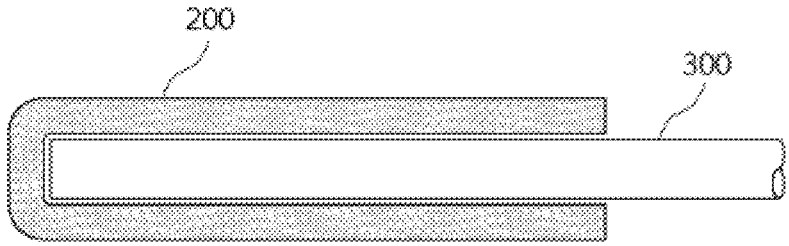
FIG. 1 illustrates an upper side of a golf club including a grip.

300*b*1-300*b*3: partial shafts which are generated by further dividing short shaft 2 into three parts

330: entire connecting rod

330*a*: lower joint core having a long width of a connecting rod

330*b*: upper joint core having a small width of a connecting rod

330*b*1 to 330*b*3: three joint cores which are installed and dispersed in the upper side of a connecting rod

400*b*: one sleeve integrally formed in one joint core

400*b*1 to 400*b*3: three sleeves integrally formed on three joint cores, respectively

BEST MODE

Hereinafter, a golf club grip having the above mentioned configuration according to the present invention will be described in detail with reference to the attached drawings.

In order to effectively explain the configuration and principle of the golf club grip of the present invention, first, a general golf club swing will be briefly described below.

In order to make a good golf swing, first, a grip posture of both hands should be good in the setup. If a golfer too strongly grabs the grip regardless of the type of the club in the golf swing, the take-away becomes unnatural and connection to the take-up becomes difficult because the axis of the grip swing is not formed well at one point of the shaft beneath both hands. On the other hand, when the golfer grabs the grip too loosely, the club moves within hands, and thus there comes to be no clear axis of the grip swing, thereby causing an inaccurate hit. For example, in the case of a putter, good putting is a motion which allows a grip swing as one axis is formed on the shaft beneath both hands by softly grabbing a club without using a wrist, and at this spot, the force of both arms is dynamically balanced with the weight of the club during a swing, and thereby the club is moved like a pendulum and the sweet spot on the club head exactly hits the ball at a right angle.

Speaking once more of a principle of a golf swing, some examples of golf swings are an upper-body-and-both-shoulder swing in which a spinal column is bent right and is severely twisted using one spinal joint on the buttocks as the axis, a left-arm swing in which a left arm is rotated on the left shoulder joint, a grip swing in which a golf club is rotated on one hinge point on the shaft beneath the grip of both hands, a wrist swing in which cocking of the right wrist is made, and a right-arm swing in which the right arm is rotated on the right shoulder. When the swings are sequentially combined well, a strong swing is possible. Each of the swings requires a balance of dynamic force during each motion, and if the dynamic balance of the force is broken, the swing track is also broken, thereby the sweet spot on the club head fails to hit the ball, thereby the side spin is generated, thereby the ball is dispersed and loses the force, and thereby the distance becomes short.

In order to better explain a structure of a grip swing, in which the axis is formed outside the body, among various swings, a simple virtual putting machine, which may accurately and repeatedly hit a golf ball, will be described below. The putting machine has a left arm which is hung down, and the left arm is fixed at a structure corresponding to the body (trunk) using a shoulder pin. One orthogonal pin is stuck on a portion considered to be a left hand or left wrist on the lower side of the left arm, and a putter is hung in a posture in which a shaft is tilted by a lie angle. Here, the orthogonal pin is parallel to the face of the putter head, and is stuck on the club shaft at a right angle. If the swing machine, which was resting to start the swing, raises up the putter using its left arm, the left arm of the swing machine receives vertical tensile force as much as the weight of the putter, and because the force of raising up the putter by the left arm in the orthogonal pin is balanced with the force of pulling down the arm by the gravity in the putter head, the orthogonal pin naturally forms the center of gravity of the swing system consisting of the left arm and the putter. On the other hand, if the weight sensors are installed in various spots of the putting machine, the left arm of the machine will sense the fact that the weight is always concentrated on the orthogonal pin while the club is swung. In other words, the putter, which is hung at the orthogonal pin, performs a second pendulum motion during the first pendulum motion of the left arm, and the orthogonal pin plays the role of the center of gravity of the dual pendulum system, which forms the first pendulum and the second pendulum, and the center of rotation of the second pendulum. The putter, which performs the second pendulum motion of the virtual machine, moves backward so that the putter head follows the target line in the back swing, and it may be understood that the backward motion of the left art, which is the first pendulum motion, is caused through the orthogonal pin, or the situation may also be understood reversely. In the forward swing of the club, the orthogonal pin is parallel to the face of the putter head and is orthogonal to the shaft, and thus when the left arm is moved in a target direction, the putter follows through the orthogonal pin and the sweet spot of the putter head hits the ball at a right angle. The physical meaning of this swing machine is that, as a hinge point plays a double role of the center of rotation and dynamic center of gravity of the pendulum in a single pendulum in which the hinge point is fixed like a clock pendulum, the orthogonal pin, which is located in the connection part of the double pendulum system formed by the arm and the club, also plays a double role of the dynamic center of gravity of the system and the center of rotation of the club.

In the present invention, in a golf club including a shaft 300 where a head for hitting a golf ball is formed at the end of one side, and a grip 200 which surrounds the shaft at the end of the other side of the shaft 300 and serves as a handle, by imitating the above mechanical swing, a center of gravity (S) is provided so that the center of gravity (S) may become the dynamic center of gravity of a dual pendulum golf swing system consisting of both arms and a golf club by selecting one or more specific positions on the shaft beneath the grip of both hands. If the golf club is grabbed using the grip of both hands, it may be felt that the weight of the club head, which is located away from hands, is in the center of gravity (S), which is one close spot within hands, and thus the center of gravity (S) may be easily adopted as a means of swing control. Additionally, the weight of the club is concentrated on the center of gravity (S) of the present invention, and thereby the swing moment of the pendulum motion may be felt big, and thus it may be easily used as the axis of the grip swing. When several centers of gravity are provided in the grip beneath hands, a mini swing, in which one upper center of gravity is used as a hinge and one lower center of gravity is used as weight, is possible, and thus swing control is easy within hands. The principle of the golf mechanics is analyzed in detail below.

A golfer raises up a club, in which the shaft is inclined by a lie angle, using both hands until the club head is placed a little away from the ground, and at this time, the force of both hands, which raises up the club, is balanced with the weight of the club, which pulls down the club. The center of gravity of the system, which becomes the equilibrium point, is certainly concentrated on the orthogonal pin in the swing machine, but in the grip of both hands of an inexperienced golfer, the contacted portion of the palm is large and the grip is tightly grabbed, and thus it is unclear at which spot the center of gravity of the system is grabbed. As the grip gets tighter, one hinge point disappears, the degree of freedom of the club rotation for both hands is deteriorated, and the following motions of several swings would not be smooth, thereby causing a distorted swing. On the other hand, if the grip of both hands is two loose, the shaft in the grip gets would be moving, thereby causing a dispersed swing.

Then what is a good grip? This is a grip in which a golfer softly grabs a grip as much as the weight of the club may be supported at the setup, thereby the center of gravity of the swing system is made at one fixed point within both hands, and thereafter a takeaway motion, which is a pendulum motion of the club, may be smoothly started using the center of gravity as the hinge point. However, the club is heavy, so a golf beginner would unconsciously put too much pressure with both hands during a swing, and in such a situation, a good swing motion would be difficult, which would be one of the factors that make the golf difficult to beginners.

The feature of the present invention is in that a artificial center of gravity (S) is provided so that the weight of the club is not dispersed, but is concentrated on one shaft point of the grip portion, thereby causing a stable swing. That is, in a dual pendulum motion formed by both arms and a club, a clear center of gravity (S), which becomes the center of rotation and dynamic center of gravity of the club on the shaft beneath grip to which both arms and the club are connected, and a stable and natural takeaway may be started by using the center of gravity as the axis of the grip swing or the weight for the mini swing within hands. In the putting which restricts rotation of a wrist, such a grip swing is particularly important, and because a soft dual pendulum motion is generated between a club and both arms using the axis of the grip swing even in a swing of a driver or iron having a big swing arc and large power, the grip swing is still important. For example, in the case of the putter, if the center of gravity (S) is used as the axis of the grip swing or the weight of a mini swing, the principle of the mechanical pendulum motion is kept, so the sweet spot of the club head hits the ball at a right angle, the inertia of the ball, which rolls with the pin, increases, the success rate increases than the conventional putter due to the straight moving line. Even in the driver or iron club according to the present invention, the dynamic balance of the swing system is formed within the grip of both hands, and thus the connection operation of the takeaway or take-up is natural and smooth, so the golfers may feel that the swing sense and the hitting sense are clearly improved.

In the present invention, the above-described center of gravity, which is installed in the grip portion of the golf club, according to the present invention will be described in more detail with reference to the embodiments explained below. FIG. 1 illustrates an extended configuration of a shaft 300 and a grip among parts of a golf club.

Figure 2:
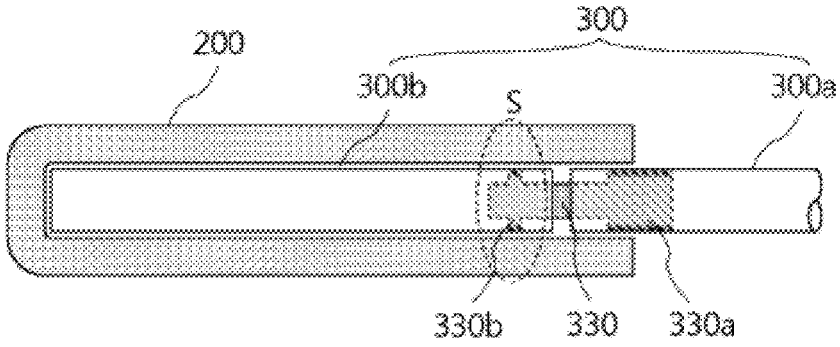
FIG. 2 illustrates one center of gravity provided in a shaft separated into two parts.

In the embodiment illustrated in FIG. 2, a shaft is cut into two parts at the entry beneath the grip 200, and thus the shaft is divided into a lower long shaft 1 300*a* and an upper short shaft 2 300*b*. The two shafts are assembled to form a single axis by one light and strong connecting rod 330 inserted inside, and the lower connection core 330*a* of the connecting rod 330 illustrated in FIG. 2 is inserted into the inside of the lower shaft 1 300*a*, and is tightly coupled through means such as welding, a screw, a rivet, a glue, shrink-fit, brazing, etc. The upper joint core 330*b* of the connecting rod 330, which forms the center of gravity (S), has a smaller width compared to the lower joint core 330*a*, and is tightly coupled through means such as welding, a screw, a rivet, a glue, shrink-fit, brazing, etc. In particular, FIG. 2 illustrates a shape coupled using welding or a glue. In addition, the upper connection core 330*b* inside the upper shaft 2 300*b* has a small width, and thus forms the center of gravity (S) because the upper connection core 330*b* may be used as a hinge of the club swing.

If a golfer grabs a grip using both hands, the force, which is shown through both arms and both hands, is transmitted, first, to the grip, then to the upper shaft 2 300*b* attached thereto, and then to the upper connection core 330*b* inside shaft 2. The weight of the head beneath the club reaches the upper connection core 330*b* through the lower shaft 1 300*a* and the connection rod and the lower connection core 330*a* connected inside the upper shaft 1 300*a*, and thus the upper connection core 330*b* naturally forms the center of gravity (S). Hence, if the golfer uses the center of gravity (S) as the axis or weight of the grip swing, the force of both arms is balanced with the weight of the club, thereby causing a stable and natural swing.

Figure 3:
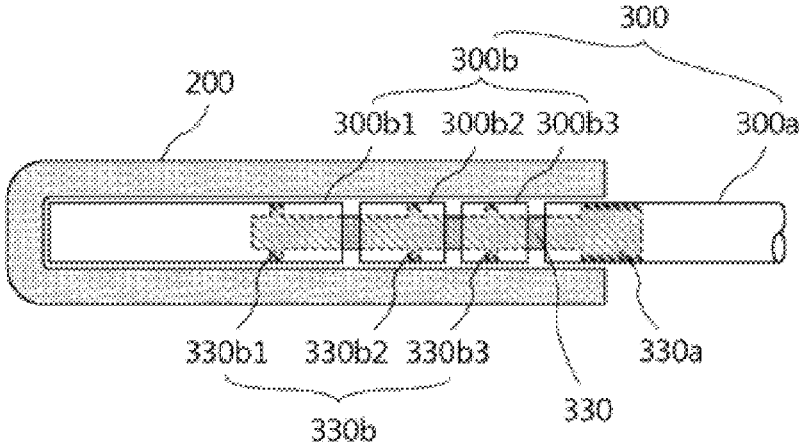
FIG. 3 illustrates three centers of gravity provided in a shaft separated into four parts.

The embodiment of FIG. 3 is a further extension of the number of the upper connection cores. Here, the upper shaft 2 300*b* is divided into two or more partial shafts. In particular, FIG. 3 illustrates a case in which the shaft is cut into three partial shafts 300*b*1, 300*b*2 and 300*b*3, and of course, the number of the upper connection cores may be 2 or four depending on the purpose of design. In the case of FIG. 3, the three distributed connection cores 330*b*1, 330*b*2 and 330*b*3, which are distributed to be coupled to each of the partial shafts 300*b*1, 300*b*2 and 300*b*3, are provided with a small width in the connecting rod 330. In the embodiment of FIG. 2, as the upper shaft 2 300*b* is firmly and mechanically coupled with the upper connection core 330*b* of the connecting rod 330, the three dispersed connection cores 330*b*1 to 330*b*3 may be respectively coupled to each of the three partial shafts 300*b*1 to 300*b*3 through means such welding, a screw, a rivet, a glue, shrink-fit, brazing, etc. As welding or a glue have been used for coupling of connection cores 330*a* and 330*b* of both ends of the connecting rod 330 in FIG. 2, FIG. 3 also illustrates an example in which the three connection cores 330*b*1 to 330*b*3 are coupled to the three partial shafts 300*b*1 to 300*b*3 by welding or a glue, but FIG. 3 is just an example, and welding, a screw, a rivet, a glue, shrink-fit, brazing, etc. may also be used for the coupling.

Figure 4:
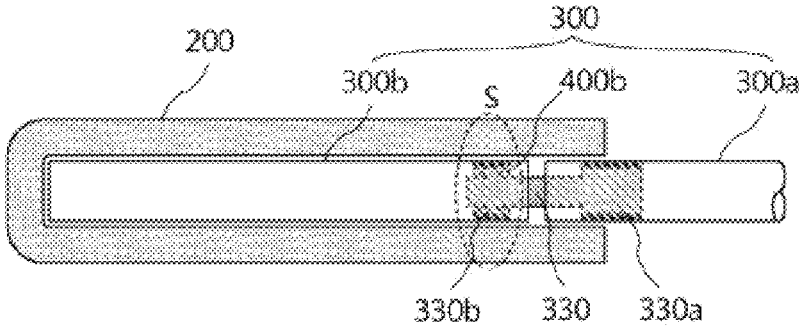
FIG. 4 illustrates one center of gravity using a connecting rod, in which a sleeve is integrally formed outside one joint core, as a means.

FIG. 4 illustrates that, in preparation of a situation that the mechanical cohesiveness is small due to the small width of the connection core of the upper side of the connecting rode coupled to the upper shaft 2 300*b*, a sleeve 400*b* of relatively a long width, which is integrally formed outside the connection core 330*b*, is provided as a structure of the connecting rod, and in order to firmly couple the sleeve 400*b* with the upper shaft 2 300*b*, various means such as welding, a screw, a rivet, a glue, shrink-fit, brazing, etc. may be used.

Figure 5:
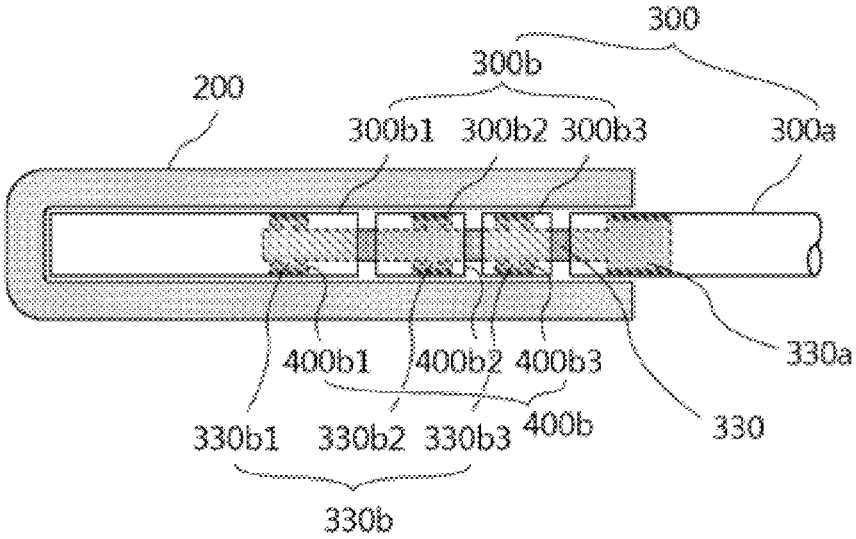
FIG. 5 illustrates three centers of gravity using a connecting rod, in which each sleeve is integrally formed outside each of three joint cores.

FIG. 5 illustrates the upper shaft 300*b*, which has been separated into three partial shafts 300*b*1 to 300*b*3, and three connecting rod connection cores 330*b*1 to 330*b*3 having a small width, which are respectively coupled with the three partial shafts 300*b*1 to 300*b*3. As a structure of the connecting rod, relatively long sleeves 400*b*1, 400*b*2 and 400*b*3 are integrally formed outside each of the three connection cores 330*b*1, 330*b*2 and 330*b*3, and may be firmly coupled with the partial shafts 300*b*1, 300*b*2 and 300*b*3 using means such as welding, a screw, a rivet, a glue, shrink-fit, brazing, etc.

Likewise, when the upper short shaft 300*b* is divided into a plurality of partial shafts 300*b* to 300*b*3 and each of the partial shafts 300*b*1 to 300*b*3 is directly coupled with the connection cores 330*b*1 to 330*b*3 of the connecting rod corresponding to the partial shafts 300*b*1 to 300*b*3, or, as a structure of the connecting rod, is indirectly coupled through the respective sleeves 400*b*1, 400*b*2 and 400*b*3 which are integrally formed outside the connection cores 330*b*1 to 330*b*3, the weight may be concentrated on any of the connection cores 330*b*1 to 330*b*3, and thus there come to be means which may variously set the center of gravity. Likewise, the reasons why extension to a plurality of centers of gravity is necessary are as follows. As described above, when the center of gravity is set only at one spot, it is theoretically ideal, but when actually grabbing a golf grip, a person uses both hands, and thus when the center of gravity is set at only one spot of one hand, the golf beginners may wonder what the role of the other hand is. At this time, if the extension structure of the center of gravity illustrated in FIG. 5 is used, the fingers of the left hand and the right hand may be appropriately distributed and positioned at each partial shaft 300*b*1 to 300*b*3, and any of these points may form the dynamic center of gravity of the swing system and thus be used as a hinge or weight for a mini swing within hands, thereby becoming outstanding swing control elements.

The connecting rod, the connection core integrally formed thereon, and the sleeve integrally formed while supporting the connection core, which are provided in the present invention, are not directional and exist inside the shaft and the grip, and thus the device of the invention is not observed from the outside and natural. Further, the weight of the club, which is applied to the connection core of the center of gravity, is clearly felt at both hands outside the shaft and the grip as if the electromagnetic force were felt from all directions, and thus the effects are strong. As such, the present invention having a plurality of centers of gravity, which may be used as hinge points and weights through all directions without changing the existing external appearance of the club, has novelty and inventiveness.

[Industrial Applicability]

The center of gravity (S) according to the present invention may be used as a hinge or weight for forming a mini swing within hands as a structure of a grip swing, and a golf swing for using the same may form a stable and soft dual pendulum motion through the center of gravity (S). As a result, accuracy and power is given to a golf swing using the present invention, and at the same time, the track of the ball becomes clear, thereby increasing a probability of a successful golf swing.

The invention claimed is:

1. A golf club comprising:

a shaft having a head hitting a golf ball at an end of one side;

a grip provided in a form of surrounding the shaft at an end of the other side of the shaft, the grip serving as a handle, wherein a center of gravity is provided on an axis of the shaft at a designed specific position inside a grip of both hands, the center of gravity concentrating weight of the golf club, wherein the shaft is cut into a lower shaft on a club head side and an upper shaft on a club grip side around a bottom entry of the grip, and is assembled to form a single axis by insertion of one connecting rod.

2. The golf club according to claim 1, wherein the grip is coupled with the cut upper shaft by accommodating all sections of the shaft.

3. The golf club according to claim 1, wherein the connecting rod is made of plastic or light metal material.

4. The golf club according to claim 1, wherein the connecting rod is directly and firmly coupled with the lower shaft using at least one means selected among welding, a screw, a rivet, a glue, shrink-fit, and brazing as a lower connection core with a small width, the end of one side, is inserted into the lower shaft.

5. The golf club according to claim 1, wherein the connecting rod is firmly coupled with the upper shaft using at least one means selected among welding, a screw, a rivet, a glue, shrink-fit, and brazing as an upper connection core with a small width, the end of the other side, is inserted into the upper shaft.

6. The golf club according to claim 1, wherein the connecting rod is firmly coupled with the upper shaft using at least one means selected among welding, a screw, a rivet, a glue, shrink-fit, and brazing as a sleeve integrally formed outside the upper connection core with a small width, the end of the other side, is inserted into the upper shaft.

7. The golf club according to claim 1, wherein the upper shaft is cut into two or more partial shafts.

8. The golf club according to claim 7, wherein the partial shafts are assembled by the connecting rod, and all of which are accommodated inside the grip.

9. The golf club according to claim 8, wherein the connecting rod integrally form a plurality of connection cores dispersed and coupled for each of the partial shafts.

10. The golf club according to claim 9, wherein the connection cores are directly coupled with each of the partial shafts using at least one means selected among welding, a screw, a rivet, a glue, shrink-fit, and brazing.

11. The golf club according to claim 9, wherein the connection cores are firmly coupled with each of the partial shafts using at least one means selected among welding, a screw, a rivet, a glue, shrink-fit, and brazing through sleeves integrally formed outside each of the connection cores.

* * * * *